US008028762B2

(12) United States Patent
Pillers, II et al.

(10) Patent No.: US 8,028,762 B2
(45) Date of Patent: Oct. 4, 2011

(54) SHOCK ABSORBER FOR A RECIPROCATING TOOL ASSEMBLY

(75) Inventors: Lauritz Phillip Pillers, II, Shorewood, IL (US); Chunhui Pan, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 915 days.

(21) Appl. No.: 11/452,377

(22) Filed: Jun. 14, 2006

(65) Prior Publication Data

US 2006/0283615 A1 Dec. 21, 2006

(30) Foreign Application Priority Data

Jun. 15, 2005 (EP) ..... 05253699

(51) Int. Cl.
*B25D 17/24* (2006.01)
*B25D 9/04* (2006.01)
*B25D 17/08* (2006.01)

(52) U.S. Cl. ..... 173/210; 173/90

(58) Field of Classification Search ..... 173/210–211, 173/90, DIG. 2; 279/19.2, 19.3, 19.5, 19.6
See application file for complete search history.

(56) References Cited

U.S. PATENT DOCUMENTS 1,142,238 A * 6/1915 Cook ..... 173/211
1,795,306 A * 3/1931 Jimerson ..... 279/19.6
1,853,128 A * 4/1932 Hysing et al. ..... 279/102
2,090,464 A * 8/1937 Allen ..... 279/19
2,512,149 A * 6/1950 Gartin ..... 279/19.5
2,547,224 A * 4/1951 MacGuire ..... 173/15
2,685,274 A 8/1954 Liddicoat
3,341,213 A * 9/1967 Lang ..... 279/103
3,525,531 A 8/1970 Ekström et al.
3,966,276 A * 6/1976 Bellarbre et al. ..... 384/215
4,081,038 A * 3/1978 Andersson et al. ..... 173/162.1
4,759,412 A 7/1988 Brazell, II
5,050,687 A * 9/1991 Prokhorov et al. ..... 173/133
5,944,120 A 8/1999 Barden (Continued)

FOREIGN PATENT DOCUMENTS

DE 801565 1/1951

(Continued)

OTHER PUBLICATIONS

Pillers, II, U.S. Appl. No. 11/452,381, filed Jun. 14, 2006, "Tool Retention Apparatus and Method" (15 pages).

(Continued)

*Primary Examiner* — Lindsay Low
(74) *Attorney, Agent, or Firm* — Murgitroyd and Company

(57) ABSTRACT

A tool assembly (10), for example a hydraulic or pneumatic hammer assembly, comprises a housing (11) defining a chamber (16), a reciprocating work tool (20) arranged in the chamber for cyclical movement in a work stroke and a return stroke, and a tool retention member (80) arranged to restrain the work tool at the end of the work stroke. The tool assembly (10) includes a shock absorber arranged to absorb impact from the work tool at the end of a stroke. The shock absorber comprises an annular resilient flange (102, 154), which may be cantilevered from the tool retention member (80) to absorb impact at the end of the work stroke or may be provided on a bushing (150) arranged to absorb impact at the end of the return stroke. The shock absorbing flange reduces the transmission of shocks into the tool assembly, thereby providing increased life for tool assembly components.

19 Claims, 5 Drawing Sheets

U.S. PATENT DOCUMENTS

| | | | | |
|---|---|---|---|---|
| 6,510,904 | B1 * | 1/2003 | Tyrrell | 173/132 |
| 6,698,537 | B2 * | 3/2004 | Pascale et al. | 175/300 |
| 2005/0016745 | A1 * | 1/2005 | Hahn | 173/132 |

FOREIGN PATENT DOCUMENTS

| | | | |
|---|---|---|---|
| DE | 1 122 909 | | 1/1962 |
| EP | 0 505 726 | A1 | 2/1992 |
| FR | 981770 | | 5/1951 |
| GB | 344689 | | 3/1931 |
| GB | 1402181 | | 8/1975 |
| JP | 7241783 | | 9/1995 |
| SE | 447501 | | 11/1986 |

OTHER PUBLICATIONS

Pillers, II, U.S. Appl. No. 11/452,324, filed Jun. 14, 2006, Tool Assembly Having a Two Part Body (19 pages).

European Search Report and non-binding opinion issued Nov. 22, 2005, in EP 05 253 699.2 (8 pages).

* cited by examiner

SHOCK ABSORBER FOR A RECIPROCATING TOOL ASSEMBLY

TECHNICAL FIELD

The present disclosure relates generally to an apparatus for absorbing impact shocks in a tool assembly having a reciprocating work tool, and more specifically to a shock absorber for a hydraulic, electric or pneumatic impact tool assembly.

BACKGROUND

Hydraulic hammers are used on work sites to break up large hard objects before such objects can be moved away. Hydraulic hammers may be mounted to back hoes or excavators, or may be hand-held. Typically, the hammer assembly is powered by either a hydraulic or pneumatic pressure source. During a work or power stroke, high fluid pressure is applied to a first shoulder of a piston, thereby driving the piston in a forward direction. The piston then strikes a work tool, commonly referred to as a tool bit, which is driven in the forward direction thereby causing a work tip of the work tool to strike the rock, concrete, asphalt or other hard object to be broken up. During a return stroke, fluid pressure is applied to a second shoulder of the piston in order to return the piston to its original position.

The work tool is retained within a sleeve, commonly referred to as a front head. Conventionally a tool retention pin is used to retain the tool within the front head. The pin extends across one side of the front head and engages with a transverse machined groove in the tool. The height of the groove is greater than the diameter of the pin, thereby allowing reciprocal forward and backward movement of the hammer over a limited range of movement. In use, when the work tip does not fully engage with the hard object on which the tool is being used, or during an idle stroke, the front head must resist the work stroke of the tool. This results in a large impact load, which causes high instantaneous stresses in the components which transfer the impact load back to the hammer body.

At least some of the disclosed embodiments may overcome one or more of the abovementioned drawbacks.

SUMMARY OF THE INVENTION

In accordance with the present disclosure there is provided a tool assembly comprising a housing defining a chamber, a reciprocating work tool arranged in the chamber for cyclical movement in a work stroke and a return stroke, and a tool retention member arranged to restrain the work tool at the end of the work stroke. The tool assembly includes a shock absorber provided on a bushing at least partially surrounding the work tool and arranged to absorb impact from the work.

DETAILED DESCRIPTION

Figure 1:
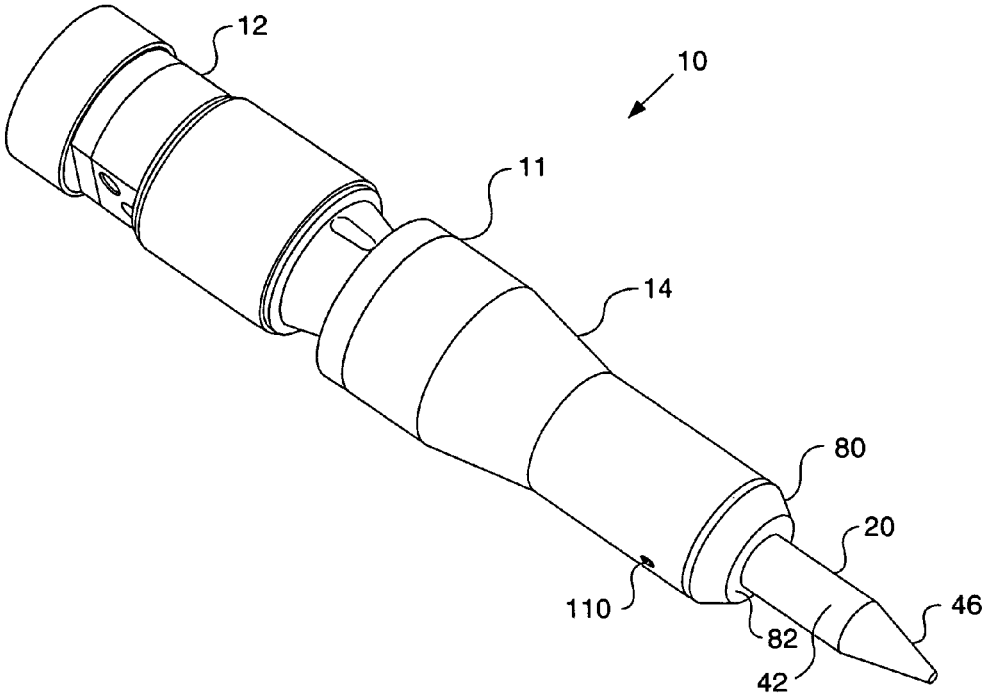
FIG. 1 is a perspective view of a hammer assembly according to one disclosed embodiment.
Figure 2:
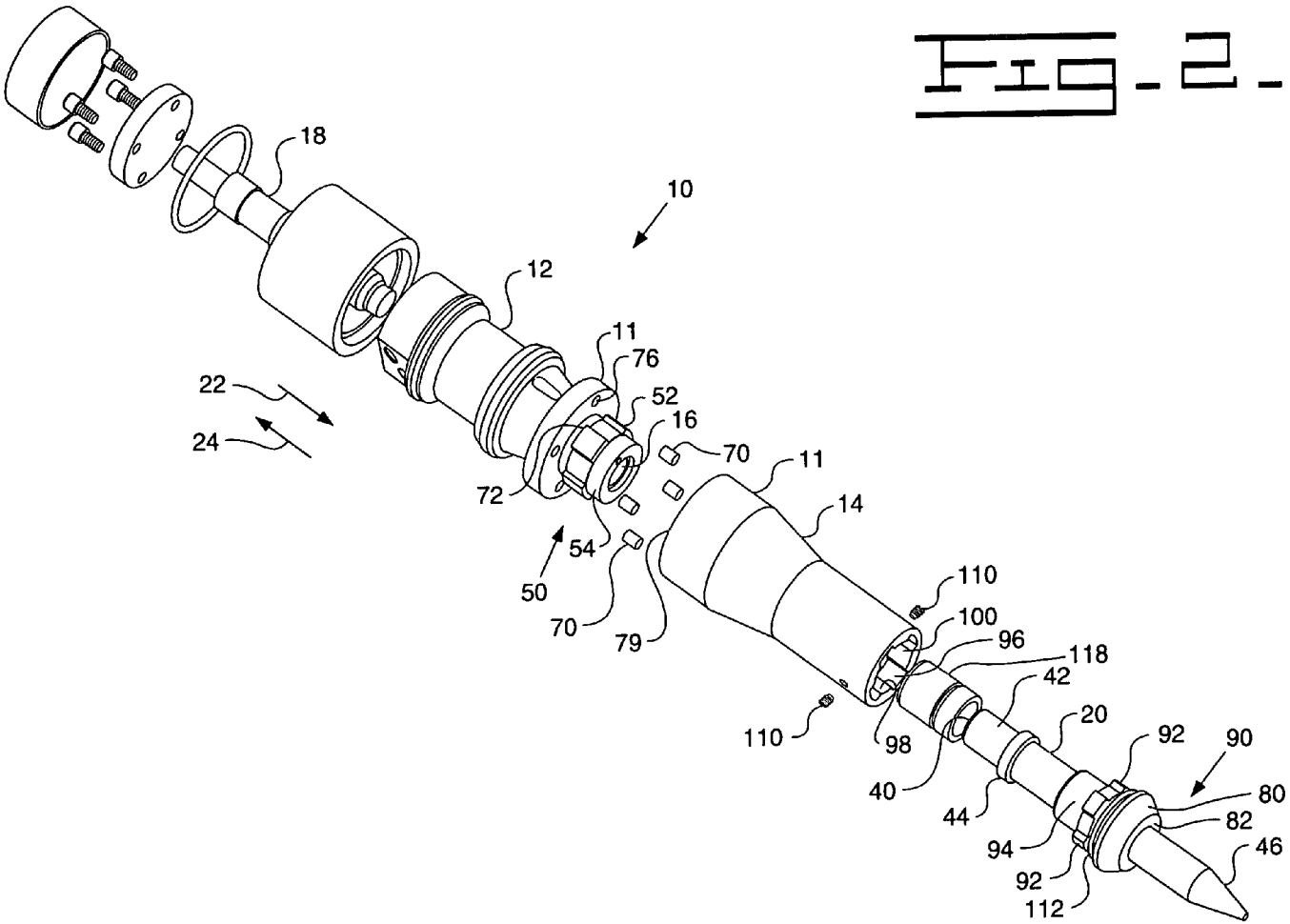
FIG. 2 is an exploded view of the hammer assembly of FIG. 1.
Figure 3:
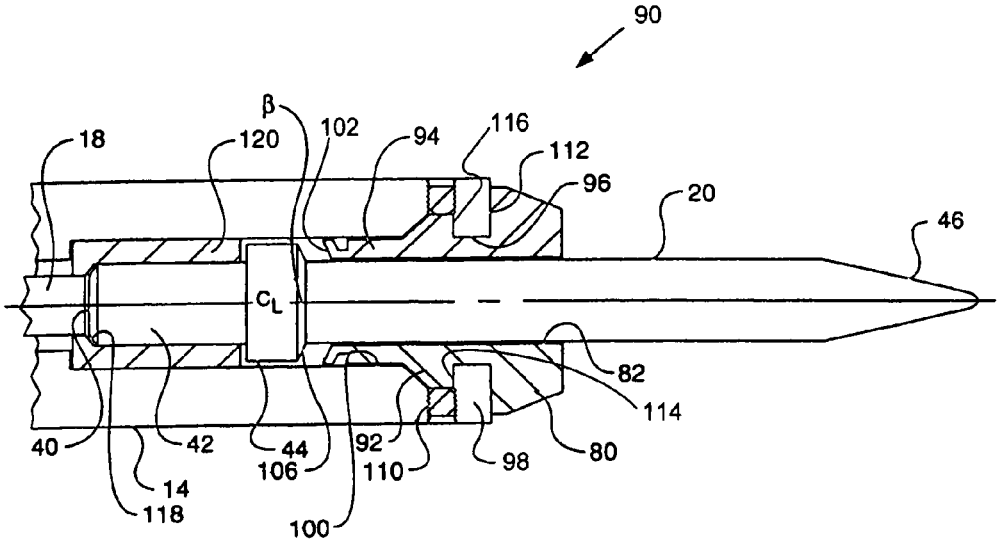
FIG. 3 shows a longitudinal section of the front head and work tool of the hammer assembly of FIG. 1.

With reference to FIGS. 1 to 3 there is shown a tool assembly 10, specifically a hydraulic hammer assembly, which may be attached to a backhoe or excavator (not shown). The tool assembly 10 includes a housing 11, a chamber 16 defined in the housing 11, a piston 18 and a work tool 20. The housing 11 is a two part housing including an upper housing member 12 and a lower housing member 14, often referred to as a front head, which define an upper and lower chamber respectively, which together make up the chamber 16. The piston 18 is operatively housed in the chamber 16 such that the piston 18 can translate in the general direction of arrows 22 and 24. In particular, during a work stroke, the piston 18 moves in the general direction of arrow 22 so as to strike the work tool 20. Conversely, during a return stroke, the piston 18 moves in the general direction of arrow 24.

A hydraulic circuit (not shown) provides pressurized fluid to urge the piston 18 towards the work tool 20 during the work stroke and to return the piston 18 during the return stroke. The hydraulic circuit is not described further, since it will be apparent to the skilled person that any suitable hydraulic arrangement may be used to provide pressurized fluid to the piston 18, such as the arrangement described in U.S. Pat. No. 5,944,120.

Figure 2A:
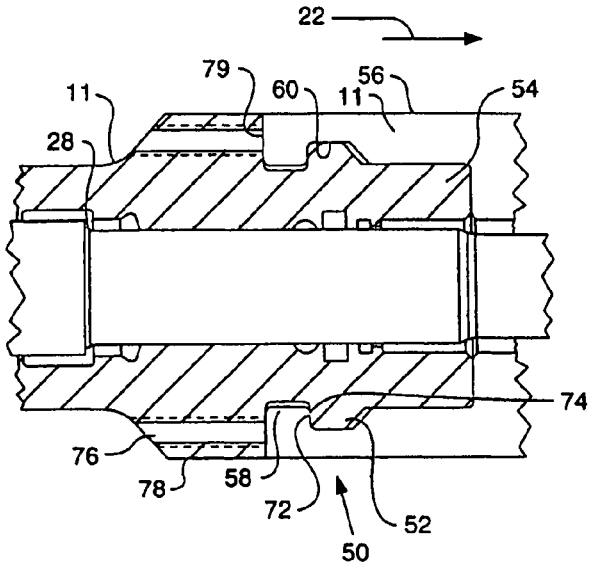
FIG. 2A shows a longitudinal section of the connection between the upper and lower housing members of the hammer assembly of FIG. 1.

Near the end of the work stroke, the piston 18 strikes the upper end 40 of the work tool 20. The work tool 20 includes a shaft 42, a retaining flange 44 and a tip 46. The shaft 42 passes through a tool retention member 80 in the form of a bushing with a central aperture 82. The aperture 82 has a diameter smaller than that of the retaining flange 44 and thereby limits the movement of the work tool 20 in the general direction of arrow 22. The tool retention member 80 can be removed from the housing 11, as described below, to allow a variety of work tools 20 with different configurations of the tip 46 to be attached to the tool assembly 10. As the piston 18 strikes the work tool 20, the force of the piston 18 is transmitted through the work tool 20 to the tip 46 in the general direction of arrow 22. Moreover, this force is applied to a hard object such as rock, concrete, or asphalt in order to break up the hard object. The upper and lower housing members 12, 14 are connected by a housing engaging structure 50, best seen in FIGS. 2 and 2A. In the illustrated embodiment the housing engaging structure 50 includes four lugs 52 provided equidistantly about the circumference of a plug portion 54 of the upper housing member 12. These are shaped such that as the plug portion 54 is inserted into a socket portion 56 of the lower housing member 14 the lugs 52 can pass between four projections 58 formed on the internal wall 60 of the socket portion 56. The upper housing member 12 is then rotated relative to the lower housing member 14 so that the lugs 52 engage beneath the projections 58.

Prestressing structure in the form of four jacking screws 70 are provided to urge the upwardly facing mating surfaces 72 of the lugs 52 against the downwardly facing mating surfaces 74 of the projections 58. The screws 70 engage in threaded apertures 76 provided equidistantly around the perimeter of a circular flange 78 of the upper housing member 12. The jacking screws 70 engage with an upwardly facing bearing surface 79 formed on the upper end of the lower housing member 14.

The tool retention member 80 and the housing 11 are connected by an engaging structure 90. In the illustrated embodiment the engagement structure 90 includes four protrusions or lugs 92 provided equidistantly about the circumference of a plug portion 94 of the tool retention member 80. These are shaped such that as the plug portion 94 is inserted into a socket portion 96 of the lower housing member 14 the lugs 92 can pass between four projections 98 formed on the internal wall 100 of the socket portion 96. The tool retention member 80 is then rotated relative to the lower housing member 14 to an engaged position so that the lugs 92 engage beneath the projections 98. It is to be understood that other forms of mutually engaging protrusions may be envisaged, and the shape and number of lugs and protrusions can be varied and are not limited to those shown in the Figures. A stop (not illustrated) may be formed on the internal wall 100 of the socket portion 96 such that upon rotation of the tool retention member 80 one of the lugs 92 comes into contact with the stop to indicate that sufficient rotation has taken place.

The tool retention member 80 has a resilient flange 102 at its upper end. The flange 102 is cantilevered from the central core of the plug portion 94 of the tool retention member 80. The flange 102 has an upper surface 104 directed towards a contact surface 106 provided on the retaining flange 44 of the work tool 20. The upper surface 104 is frustoconical and has a cone angle $\alpha$ which in the illustrated embodiment is of the order of 60 degrees, but can be between 30 and 90 degrees. The contact surface 106 on the work tool 20 is also frustoconical and has a cone angle $\beta$, which is greater than the cone angle $\alpha$ of the upper surface 104, so that when the contact surface 106 impacts the upper surface 104 the initial contact is at the free end 107 of the cantilevered resilient flange 102. In the illustrated embodiment the cone angle $\beta$ is 70 degrees, but may be between 40 and 90 degrees.

Locking structure in the form of two set screws 110 are provided in apertures in the housing 11. These engage with the plug portion 94 of the tool retention member 80 and prevent relative rotation of the tool retention member 80 and housing 11. However, any other suitable locking structure may be provided, and the locking structure may be omitted if required.

Prestressing structure in the form of a resilient seal ring 112 are provided to urge the first mating surfaces 114 of the projections 98 on the housing 11 against the second mating surfaces 116 of the lugs 92 on the tool retention member 80.

Movement of the tool 20 in the direction of arrow 22 is limited by the impact of the retaining flange 44 with the lower bushing or tool retention member 80, while movement of the tool 20 in the direction of arrow 24 is limited by the impact of the top of the tool 40 with a shoulder 118 of a cylindrical tool stop 120 which in turn engages with the lower housing member 14.

Although the disclosed embodiments have been described with reference to lugs and projections, it is to be understood that other forms of mutually engaging protrusions may be provided. For example the second mating surface on the tool retention member 80 may be provided on a helical protrusion which forms a male thread and engages with the first mating surface of a corresponding helical protrusion on the housing 11, serving as a female thread. In another example the engaging structure may be a bayonet coupling in which two or more pins are provided on the plug portion 94 of the tool retention member 80, the pins engaging with two or more L-shaped slots provided on the internal surface of the socket portion 96.

Although the disclosed embodiments have has been described with reference to an embodiment in which the plug portion 94 is formed on the tool retention member 80 and the socket portion 96 is formed on the housing 11, the engaging structure may be reversed, so that the plug portion is formed on the housing 11 and the socket portion is formed on the tool retention member 80.

Although the prestressing structure described above comprises a resilient seal ring 112, other prestressing structure may be used, such as springs or other resilient structure which urge the tool retention member 80 and housing 11 apart. In the case of corresponding helical protrusions on the tool retention member 80 and housing 11 the prestressing structure may be the elastic or plastic deformation of the threads under a tightening torque on the housing members.

INDUSTRIAL APPLICABILITY

In use, the energy of the piston 18 is transmitted to the work tool 20. If the work tool 20 is engaged with a hard object such as rock, concrete or asphalt, a large proportion of the energy is transmitted to the hard object in order to break up the hard object. However a proportion of the energy is transmitted to the tool retention member 80, and this proportion increases if the work tool 20 is not fully engaged with the hard object or during an idle stroke. This energy is transmitted further from the tool retention member 80 to the housing 11 and in practice serves to pull the upper and lower housing apart. The resilient flange 102 serves as a shock absorber to reduce the peak force applied by the work tool to the tool retention member 80, and thus reduces the stresses elsewhere in the tool assembly.

When the contact surface 106 of the work tool 20 impacts the upper surface 104 of the resilient flange 102, the initial contact is at the free end 107 of the cantilevered resilient flange 102. The flange then deforms as the work tool 20 continues to move downwards, so that the contact force increases with time. The impact is thus spread over time, resulting in a reduced peak force compared to the situation with no shock absorber.

Figure 6:
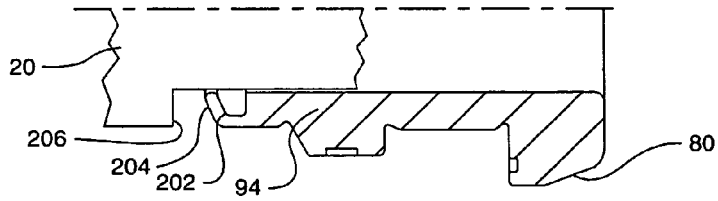
FIG. 6 shows a partial longitudinal section of the bushing and work tool of another hammer assembly according to a disclosed embodiment.

Although the disclosed embodiments have been described with reference to a resilient flange which extends radially outwardly from its root, it is to be understood that the flange could be arranged to extend radially inwardly, as shown in FIG. 6. The resilient flange 202 extends inwardly from its root at the outer perimeter of the plug portion 94 of the tool retention member 80. The upper surface 204 of the flange 202 is frustoconical, and comes into contact with a planar or frustoconical contact surface 206 of the work tool 20.

Figure 7:
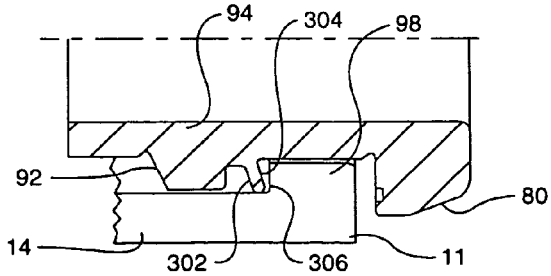
FIG. 7 shows a partial longitudinal section of the bushing and housing of a further hammer assembly according to a disclosed embodiment.

Although the disclosed embodiments have been described with reference to a resilient flange provided at the upper end of the tool retention member 80, it is to be understood that the flange could be arranged at an intermediate position to act between the tool retention member 80 and the housing 11, as shown in FIG. 7. The resilient flange 302 is discontinuous and is only provided at the portions of the perimeter of the plug portion 94 corresponding to the lugs 92 of the tool retention member 80. The lower surface 304 of the flange 302 is frustoconical, and comes into contact with planar or frustoconical contact surfaces 306 provided on the projections 98 on the housing 11. In this embodiment the tool retention member 80 will move with the work tool 20 while energy is absorbed and the resilient flange deforms.

Figure 8:
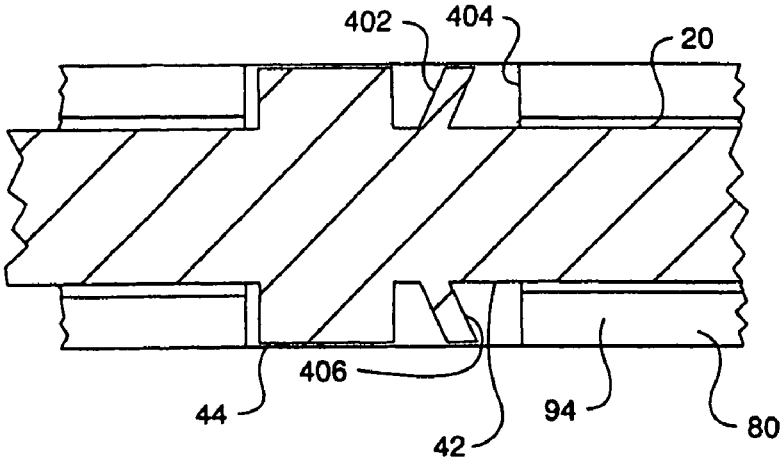
FIG. 8 shows a partial longitudinal section of the bushing and work tool of yet a further hammer assembly according to a disclosed embodiment.

Although the disclosed embodiments have been described with reference to the resilient flange being provided on the tool retention member 80, it is to be understood that the flange could be provided on the work tool 20, as shown in FIG. 8. The resilient flange 402 extends radially outwardly from its root at the shaft 42 of the work tool 20. The upper surface 404 of the tool retention member 80 is frustoconical or planar, and comes into contact with a frustoconical contact surface 406 on the resilient flange 402.

Figure 4:
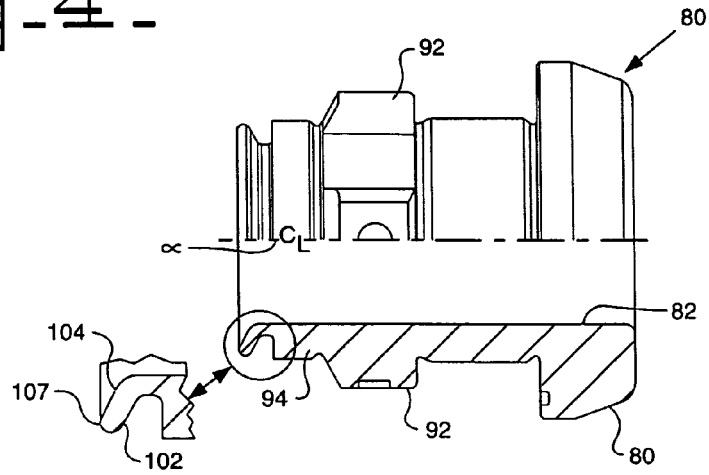
FIG. 4 shows a partial longitudinal section of the bushing of the hammer assembly of FIG. 1.
Figure 5:
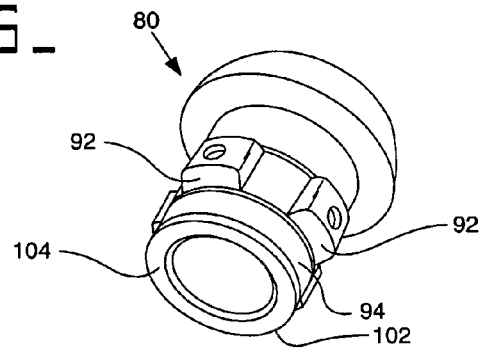
FIG. 5 is a perspective view of the bushing of FIG. 4.
Figure 9:
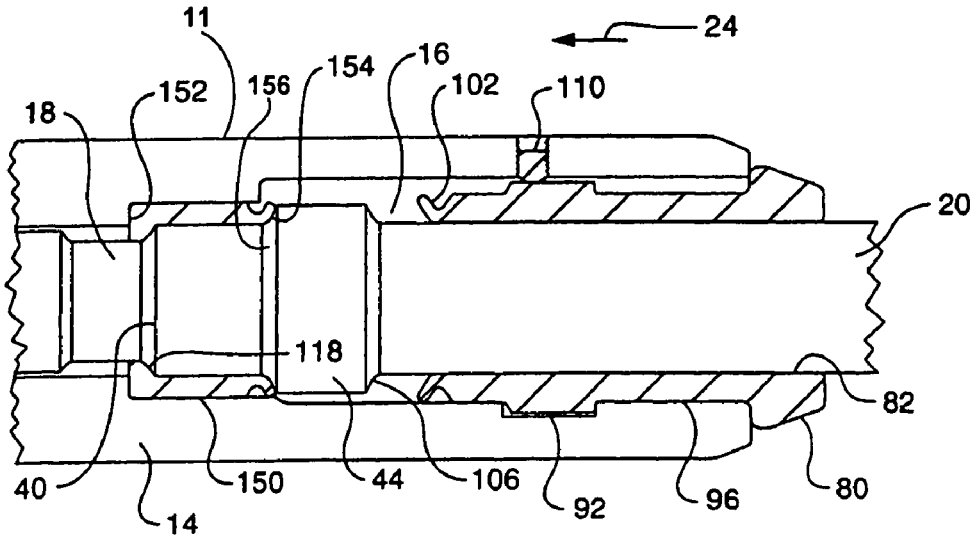
FIG. 9 shows a partial longitudinal section of the bushing and work tool of another hammer assembly according to a disclosed embodiment.

In the embodiment of FIG. 9 the tool retention member 80 is similar to that described above with reference to FIGS. 3 to 5, and like reference numerals are used to denote like parts. In the upper half of FIG. 9 the tool retention member 80 is shown in the unengaged position, while in the lower half it is shown in the engaged position. In addition there is provided a shock absorbing bushing 150 mounted in the chamber 16 in the lower housing member 14. The bushing 150 is restrained against movement in the direction of arrow 24 by a downward facing annular bearing surface 152 provided on the inner surface of the lower housing member 14. The bushing has a resilient flange 154 which acts to lessen the impact of the tool 20 when it rebounds after a work stroke. The retaining flange 44 of the tool 20 has a frustoconical or planar contact surface 156 which comes into contact with the corresponding contact surface on the resilient flange 154 before the end 40 of the tool 20 comes into contact with the shoulder 118 of the bushing 150, thereby reducing shocks into the hammer and machine. It is to be understood that the shock absorbing bushing 150 can be provided independently of the shock absorbing flange 102 on the tool retention member 80.

Although the disclosed embodiments have been described with reference to a hammer assembly in which the tool is driven by a hydraulically actuated piston, the disclosure is applicable to any tool assembly having a reciprocating work tool movable within a chamber by suitable drive structure and/or return structure, including hammer assemblies which utilize a traditional pin arrangement to secure the work tool in the front head. The disclosure encompasses pneumatic tools, electric tools and other impact tools, and both machine mounted tool assemblies as well as hand held tool assemblies.

At least some of the disclosed embodiments may offer the advantage of an increased life for tool assembly components, and may reduce the risk of damage to the machines to which the tool assemblies may be mounted. Furthermore, because of the increased contact area, noise may be reduced.

While the disclosed embodiments have been illustrated and described in detail in the drawings and foregoing description, such illustration and description are to be considered as exemplary and not restrictive in character, it being understood that only exemplary embodiments have been shown and described and that all changes and modifications that come within the spirit of the disclosure are desired to be protected.

The invention claimed is:

1. A tool assembly comprising a housing defining a chamber, a reciprocating work tool arranged in the chamber for cyclical movement in a work stroke and a return stroke, and a tool retention member arranged to restrain the work tool at the end of the work stroke, wherein the tool assembly includes a shock absorbing resilient flange forming part of a bushing, the shock absorbing resilient flange at least partially surrounding the work tool and arranged to absorb impact from the work tool.

2. A tool assembly according to claim 1, wherein the shock absorbing resilient flange is cantilevered from the bushing.

3. A tool assembly according to claim 1, wherein the bushing is part of the tool retention member and has an aperture through which the work tool extends, and wherein the housing includes an engaging structure which permits the engagement of the tool retention member with the housing by relative rotation of the tool retention member and housing.

4. A tool assembly according to claim 3, wherein the engaging structure includes mutually engaging protrusions on the tool retention member and the housing.

5. A tool assembly according to claim 1, wherein the work tool includes a contact surface arranged to impact with the tool retention member at the end of the work stroke.

6. A tool assembly according to claim 1, wherein the shock absorbing resilient flange is an annular resilient flange forming part of the bushing and arranged to impact with a contact surface on the work tool at the end of the return stroke.

7. A tool assembly according to claim 2, wherein the resilient flange is arranged such that the initial contact between a contact surface of the work tool and the resilient flange during impact is at a free end of the cantilevered resilient flange.

8. A tool assembly according to claim 7, wherein the resilient flange has an upper surface directed toward the contact surface of the work tool, the upper surface being frustoconical and having a cone angle of between 30 degrees and 90 degrees.

9. A tool assembly according to claim 8, wherein the contact surface of the work tool is frustoconical and has a cone angle greater than the cone angle of the upper surface of the resilient flange.

10. A tool assembly according to claim 4, wherein a resilient flange is arranged on the protrusions provided on the tool retention member, such that on impact between the work tool and the tool retention member during the work stroke, the resilient flange permits resilient relative movement of the tool retention member and housing.

11. A tool assembly according to claim 10, wherein the resilient flange is discontinuous.

12. A tool assembly according to claim 11, wherein the resilient flange has a lower surface directed toward a contact surface of the housing, the lower surface being frustoconical and having a cone angle of between 30 degrees and 90 degrees.

13. A tool assembly according to claim 12, wherein the contact surface of the housing is frustoconical and has a cone angle greater than the cone angle of the lower surface of the resilient flange.

14. A hydraulic hammer comprising a tool assembly, wherein the tool assembly includes a housing defining a chamber, a reciprocating work tool arranged in the chamber for cyclical movement in a work stroke and a return stroke, and a tool retention member arranged to restrain the work tool at the end of the work stroke, wherein the tool assembly includes a shock absorbing resilient flange forming part of a bushing, the shock absorbing resilient flange at least partially surrounding the work tool and arranged to absorb impact from the work tool.

15. The hydraulic hammer of claim 14, wherein the bushing is part of the tool retention member and has an aperture through which the work tool extends, and wherein the housing includes an engaging structure which permits the engagement of the tool retention member with the housing by relative rotation of the tool retention member and housing.

16. The hydraulic hammer of claim 15, wherein the engaging structure includes mutually engaging protrusions on the tool retention member and the housing.

17. The hydraulic hammer of claim 14, wherein the work tool includes a contact surface arranged to impact with the tool retention member at the end of the work stroke.

18. The hydraulic hammer of claim 14, wherein the shock absorbing resilient flange is an annular resilient flange forming part of the bushing and arranged to impact with a contact surface on the work tool at the end of the return stroke.

19. A hydraulic hammer comprising a tool assembly, wherein the tool assembly includes a housing defining a chamber, a reciprocating work tool arranged in the chamber for cyclical movement in a work stroke and a return stroke, and a tool retention member arranged to restrain the work tool at the end of the work stroke, wherein the tool assembly includes a shock absorbing resilient flange forming part of the work tool, the shock absorbing resilient flange at least partially surrounding the work tool and arranged to absorb impact from the work tool, wherein the tool retention member is at least partially in the housing, and wherein the resilient flange is arranged to impact with a contact surface on the tool retention member at the end of the work stroke.

* * * * *